US007753353B2

(12) United States Patent
McNamara

(10) Patent No.: US 7,753,353 B2
(45) Date of Patent: Jul. 13, 2010

(54) VERTICAL SHEET COMPILING APPARATUS AND METHODS OF VERTICALLY COMPILING SHEETS

(75) Inventor: Joseph Michael McNamara, Orangeville (CA)

(73) Assignee: Xerox Corporation, Norwalk, CT (US)

( * ) Notice: Subject to any disclaimer, the term of this patent is extended or adjusted under 35 U.S.C. 154(b) by 616 days.

(21) Appl. No.: 11/686,064

(22) Filed: Mar. 14, 2007

(65) Prior Publication Data

US 2008/0224379 A1 Sep. 18, 2008

(51) Int. Cl.
*B65H 37/04* (2006.01)

(52) U.S. Cl. ..... 270/37; 270/32; 270/45; 270/58.07; 270/58.08; 270/58.09; 270/58.11; 270/58.12; 270/58.17

(58) Field of Classification Search ..... 270/4, 270/17, 20.1, 32, 37, 45, 51, 58.07, 58.08, 270/58.09, 58.11, 58.12, 58.17
See application file for complete search history.

(56) References Cited

U.S. PATENT DOCUMENTS 4,371,155 A * 2/1983 Astero et al. ..... 270/58.17
5,288,062 A * 2/1994 Rizzolo et al. ..... 270/58.12
5,352,177 A * 10/1994 Walter ..... 493/23
5,398,918 A * 3/1995 Rizzolo et al. ..... 270/58.08
6,145,825 A * 11/2000 Kunihiro et al. ..... 270/58.09
6,276,677 B1 * 8/2001 Hommochi et al. ..... 270/32
6,349,934 B1 * 2/2002 Ishiguro et al. ..... 271/218
6,799,759 B1 10/2004 McNamara et al.
7,413,177 B2 * 8/2008 Mori et al. ..... 270/58.09
2006/0018696 A1 * 1/2006 Mori et al. ..... 399/407
2007/0138726 A1 * 6/2007 Tamura et al. ..... 270/37

* cited by examiner

*Primary Examiner*—Gene Crawford
*Assistant Examiner*—Leslie A Nicholson, III
(74) *Attorney, Agent, or Firm*—Oliff & Berridge, PLC

(57) ABSTRACT

A vertical sheet compiling apparatus and method compile sheets in a slot that accumulates a plurality of sheets. The slot includes a first baffle and a second baffle that each define generally vertical sides of a sheet path of the slot. The first and second baffles are separated from each other by a space therebetween. An actuator is coupled to at least one of the first and second baffles to move one of the baffles toward or away from the other one of the baffles, thereby adjusting a width of the sheet path as the sheets compile in the slot. A binding mechanism fastens the plurality of sheets together. The apparatus and method may also include a sensing device for determining an amount of available space in the slot during compilation of the sheets in the slot. The determined amount of space can be used to control movement of the baffle(s).

14 Claims, 3 Drawing Sheets

VERTICAL SHEET COMPILING APPARATUS AND METHODS OF VERTICALLY COMPILING SHEETS

BACKGROUND

The present disclosure relates to vertical sheet compiling apparatus and methods of vertically compiling sheets.

Cross-referenced is commonly assigned U.S. Pat. No. 6,799,759, the disclosure of which is incorporated herein by reference in its entirety. That patent discloses an apparatus for folding a set of sheets, for example to make booklets. The apparatus includes means defining a slot for accumulating sheets. The slot includes two sidewalls and a bottom. The apparatus also includes a selectably-operable contact member operable to press the accumulated sheet(s) against one of the sidewalls and means for operating the contact member following entry of a sheet into the slot. The means for operating the contact member retracts the contact member during entry of a sheet into the slot. The apparatus further includes a crease roll disposed adjacent to the slot, a blade for directing the set of sheets toward the crease roll, a stapler positioned to staple a set of sheets within the slot, and an elevator that moves the bottom wall and thus the collected sheets(s) within the slot. The elevator and contact member are operable so that the contact member presses collected sheet(s) against one of the sidewalls as the elevator moves a predetermined portion of the sheet(s) to a position between the stapler and the blade.

Compiling apparatus and systems are used in a variety of image forming devices and finishing devices. An example of a finishing device is a booklet maker. Booklet makers are devices for forming folded booklets which usually are stapled along a crease thereof. It is becoming common to include booklet makers in conjunction with office-range copiers and printers (as used herein, a "copier" will be considered a type of "printer"). In basic form, a booklet maker includes a slot for accumulating signature sheets, such as could be produced by a printer. The accumulated sheets, forming the pages of a booklet, are positioned within a stack so that a stapler mechanism and complementary anvil device can staple the stack precisely along the intended crease line. The creased and stapled sheet sets are then pushed, by a blade, completely through crease rolls, to form the final main fold in the finished booklet. The finished booklets are then accumulated in a tray downstream of the crease rolls.

SUMMARY

Current booklet maker systems use a fixed width paper path slot to accept a maximum set size thickness. When vertically compiling sheets in a fixed width paper path, a smaller set size (i.e., less than the maximum number of sheets the paper path is designed for), results in excess space in the paper path. The excess space in the paper path allows the sheets to sag and buckle in the path. The sagging and buckling can result in imperfections in the placement of binding material (such as staples), and/or imperfections in the folding of the booklet by a blade. That is, the sagging and buckling can alter the location of the true midpoint of the sheets during binding and/or folding. Accordingly, set registration (the position of a given sheet in the set relative to other sheets in the set) is degraded. Furthermore, the sagging and buckling can also effectively close off the paper slot thereby preventing or impeding following sheet(s) from entering the slot and causing jams or misregistration (poor alignment in the direction of sheet travel).

The present disclosure relates to improved vertical compiling apparatus and methods that can be used, for example, in a booklet maker to prevent sagging and buckling of sheets in a paper path and improve set registration. Exemplary apparatus and methods prevent sagging and buckling of the sheets in a paper path by automatically controlling/adjusting the paper path width as the sheets compile in the slot to increase or decrease the paper path width depending on the set size.

Exemplary embodiments provide a vertical sheet compiling apparatus including a slot that accumulates a plurality of sheets, the slot including a first baffle and a second baffle, the first baffle and the second baffle defining generally vertical sides of a sheet path of the slot and being separated from each other by a space therebetween. In addition, an actuator coupled to at least one of the first and second baffles moves at least one of the baffles toward or away from the other one of the baffles, thereby adjusting a width of the sheet path as the sheets compile in the slot. The apparatus also may include a binding mechanism that fastens the plurality of sheets together.

In exemplary embodiments, the apparatus can move a baffle to avoid excess space in the paper path by automatically controlling/adjusting the paper path width as the sheets compile in the paper path. As a result, sagging and buckling of the sheets in the paper path is prevented. The exemplary apparatus can also control/adjust the paper path width to increase or decrease the paper path width depending on the sheet set size as the sheets compile in the slot. Accordingly, set registration is enhanced. In general, at the start of a set compiling operation, the baffles are located closest to each other, and the baffles are caused to move away from each other as sheets accumulate in the paper path.

In exemplary embodiments, the first baffle is a fixed baffle, the second baffle is a movable baffle, and the actuator is coupled to and moves the movable baffle.

In exemplary embodiments, a second actuator is disposed at an upper portion of the sheet path. The second actuator moves an upper portion of the movable baffle independently from a lower portion of the movable baffle, thereby adjusting a width of an upper portion of the sheet path to a width different than a width of a lower portion of the sheet path. In this exemplary embodiment, set registration is further improved by optimizing the compiling of sheets against one of the baffles. In preferred embodiments, the upper portion of the sheet path is maintained at a width that is larger than a width of the lower portion.

In exemplary embodiments, the apparatus is a booklet maker and further comprises a blade to fold at least one sheet accumulated in the slot.

In exemplary embodiments, a lift mechanism is movable within the slot to move a predetermined portion of the sheet(s) accumulated in the slot to a position for folding and/or to a position for binding.

The binding mechanism can include a stapler.

The actuator can include a motor.

In some exemplary embodiments, the vertical sheet compiling apparatus may be incorporated in a xerographic device.

Further exemplary embodiments can provide a vertical sheet compiling apparatus as described above, the apparatus further including means for determining an amount of available space in the slot during compilation of the sheets in the slot. The actuator moves at least one of the baffles toward or away from the other one of the baffles based on the determined amount of available space, thereby adjusting the width of the sheet path as the sheets compile in the slot.

In some exemplary embodiments, the means for determining an amount of available space can include a sensor, such as, for example, an optical sensor. The optical sensor can detect the amount of available space in the slot as sheets accumulate in the slot.

In addition, a method of compiling sheets includes accumulating a plurality of sheets in a slot, the slot including a first baffle and a second baffle, the first baffle and the second baffle defining generally vertical sides of a sheet path of the slot and being separated from each other by a space therebetween; moving at least one of the first and second baffles toward or away from the other one of the baffles, thereby adjusting the width of the sheet path as the sheets compile in the slot; and fastening the plurality of sheets together.

The method can further include monitoring a width of the sheet path during compilation of the sheets in the slot; generating a width signal that is received by an electronic control unit; sending a control signal from the electronic control unit to an actuator coupled to at least one of the baffles; and moving the at least one of the baffles via the actuator based on the width signal.

The first baffle can be a fixed baffle, the second baffle can be a movable baffle, and the second baffle is moved in the moving step.

The method can further include moving an upper portion of the movable baffle independently from a lower portion of the movable baffle, thereby adjusting a width of an upper portion of the sheet path to a width different than (preferably, larger than) a width of the lower portion of the sheet path.

The method can further include folding at least one sheet accumulated in the slot.

The fastening step can include stapling.

The term "image forming device" or "printer" as used herein broadly encompasses various printers, copiers, fax machines, finisher modules, multifunction machines or systems, xerographic or otherwise, unless specifically defined in a different manner.

BRIEF DESCRIPTION OF THE DRAWINGS

Various exemplary embodiments are described in detail, with reference to the following figures, in which.

DETAILED DESCRIPTION OF EMBODIMENTS

Figure 1:
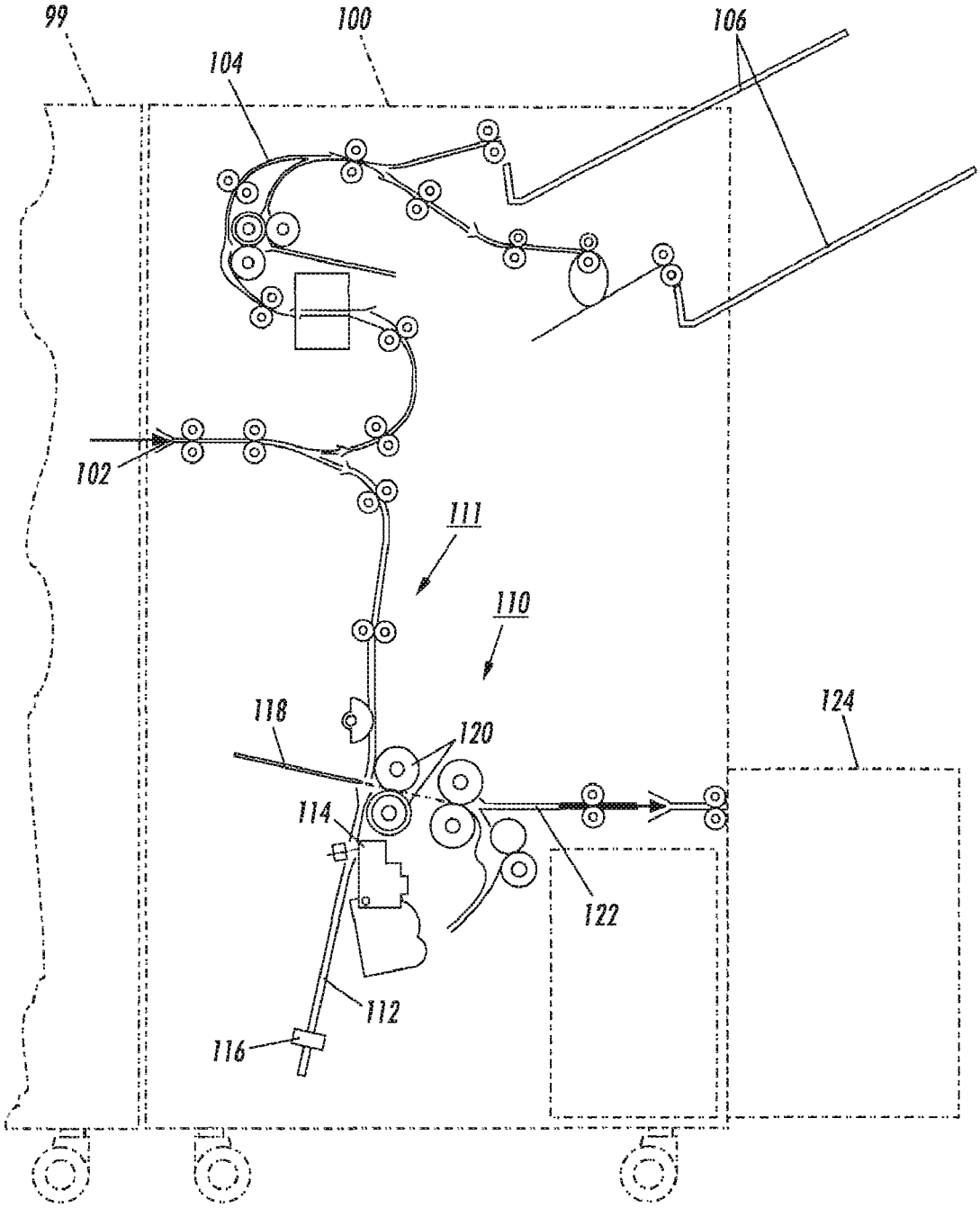
FIG. 1 is a simplified elevation view of a finisher module including a booklet maker with which the disclosed vertical compiling apparatus may be used.

FIG. 1 is a simplified elevation view of a finisher module 100. The finisher module 100 includes a booklet maker 110. The finisher module 100 with the booklet maker 110 could be used with an office-range digital printer. Printed sheets from a printer 99 are accepted in an entry port 102. The finisher module 100, depending on its specific design, may include one or numerous sheet paths 104 and output trays 106 for print sheets. These paths and trays may correspond to different desired actions, such as binding, hole-punching and C- or Z-folding. The various rollers and other devices which contact and handle sheets within finisher module 100 are driven by various motors, solenoids and other electromechanical devices (not shown), under a control system that typically includes a microprocessor (not shown), within the finisher module 100, printer 99, or elsewhere, in a manner generally familiar in the art.

The booklet maker 110 includes a slot 112. Slot 112 accumulates sheets (such as signature sheets that each have four page images thereon, for eventual folding into pages of the booklet) from the printer 99. Each sheet is held within slot 112 at a level where a binding mechanism 114 can bind the sheets along a midline that corresponds to the eventual crease of the finished booklet. The binding mechanism 114 can be a stapler. The binding mechanism 114 can also be a sewing apparatus or other device that stitches or ties the sheets together along the crease with thread or wire. Furthermore, the binding mechanism 114 may comprise an adhesive dispensing material to fasten the sheets together along the crease thereof.

In order to hold sheets of a given size at the desired level relative to the binding mechanism 114, there is provided at the bottom of slot 112 a lift mechanism 116. The lift mechanism 116 forms the bottom or "floor" of the slot 112 so that the edges of the accumulating sheets rest on the lift mechanism 116 before they are fastened together. The lift mechanism 116 is movably placed at different locations along slot 112 depending on the size of the incoming sheets, so that the trailing edge of the sheets will initially be adjacent a sheet ordering roll assembly 111. The lift mechanism 116 may act as an elevator that is movable (by means not shown, but typically including a motor or solenoid) among three positions for a given sheet size: a first position where the trailing edge of the sheets are adjacent the sheet ordering roll assembly 111; a second position where the midpoint of the sheets are adjacent the binding mechanism 114, and a third position, as will be described below.

As printed sheets are output from printer 99, the lift mechanism 116 is positioned so that the trailing edge of the output sheets (which would be at the top of slot 112) are disposed at sheet ordering roll assembly 111. When all of the necessary sheets to form a desired booklet are accumulated in slot 112, elevator 116 is moved from its first position to a second position where the midpoint of the sheets are adjacent the binding mechanism 114. The binding mechanism 114 is activated to place one or more staples, for example, along the midpoint of the sheets, where the booklet will eventually be folded.

After the stapling, the lift mechanism 116 is moved from its second position to a third position, where the midpoint of the sheets are adjacent a blade 118 and a nip formed by crease rolls 120. The action of blade 118 and crease rolls 120 performs the final folding, and sharp creasing, of the sheets into the finished booklet. The blade 118 contacts the sheet set alone the bound midpoint thereof, and bends the sheet set toward the nip of crease rolls 120, which draw all the sheets in and form a sharp crease. The creased and bound sheet set is then drawn, by the rotation of crease rolls 120, completely through the nip to form the final main fold in the finished booklet. The finished booklets are then conducted along path 122 and collected in a tray 124.

Figure 2:
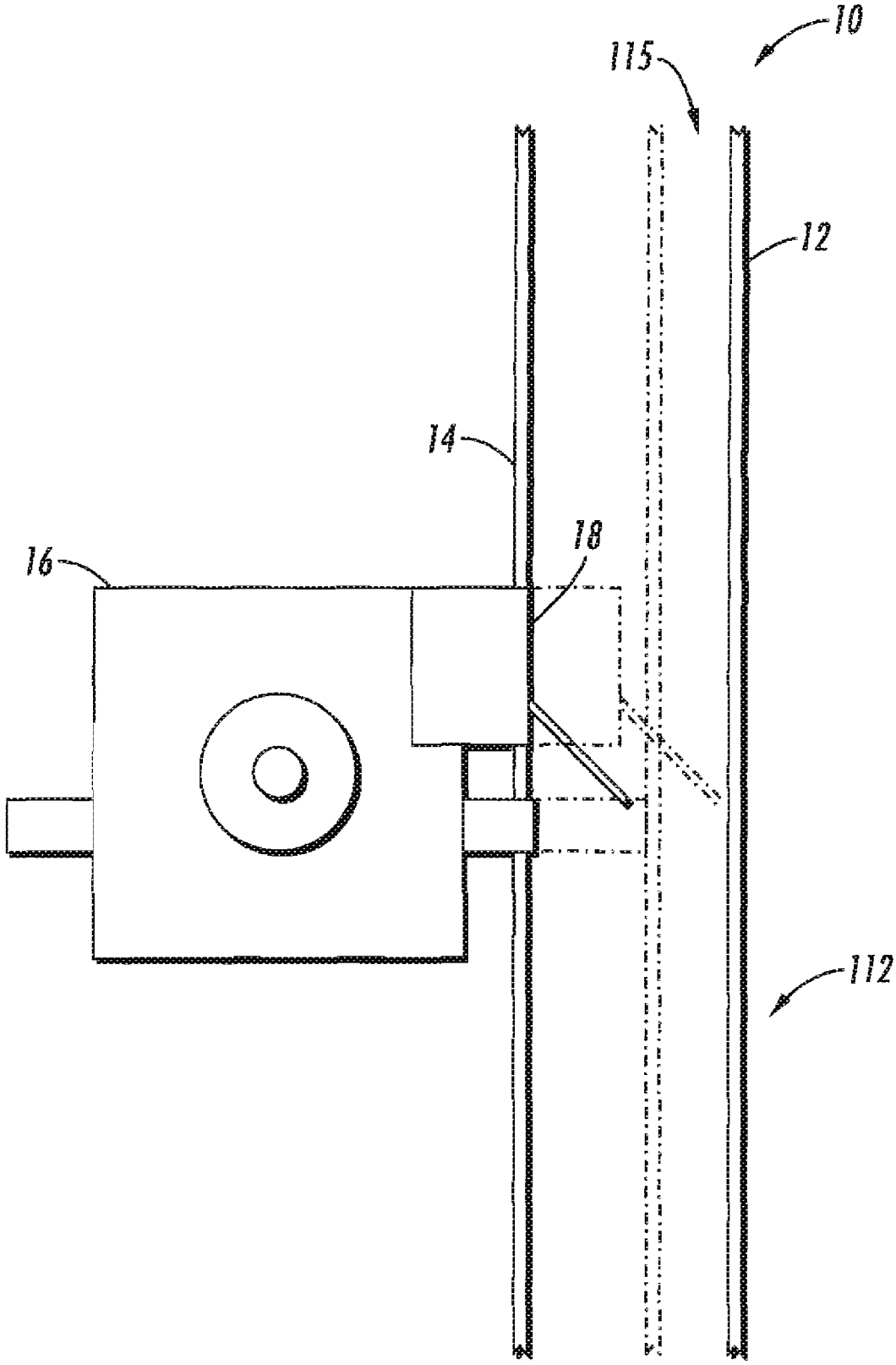
FIG. 2 is a detail view of an exemplary vertical compiling apparatus.

FIG. 2 is a detail view showing the configuration of an exemplary vertical compiling apparatus 10 in conjunction with the booklet maker 110 shown in FIG. 1. However, the apparatus 10 is not limited to use in a booklet maker, and may be used in other operations that vertically compile sheets in the environment of a copier, xerographic device, multifunction machine, for example.

The vertical compiling apparatus 10 includes the slot 112, an actuator 16, and may also include the binding mechanism 114 shown in FIG. 1. The slot 112 includes a first baffle 12 and a second baffle 14. The first baffle 12 and the second baffle 14 define generally vertical sides of a sheet path 115 of the slot 112. The first baffle 12 and the second baffle 14 are separated from each other by a space therebetween. In the illustrated embodiment, the first baffle 12 is a fixed baffle and the second baffle 14 is a movable baffle. The actuator 16 is coupled to and moves the movable baffle 14. In alternative embodiments, baffle 14 can be fixed and baffle 12 movable, or both baffles could be movable. Thus, the apparatus 10 may comprise two movable baffles or one movable baffle.

The actuator 16 may be any device that can move the movable baffle 14. For example, the actuator may include a motor. The motor may be a stepper motor with rack and pinion design. In alternative embodiments, the actuator 16 can include a solenoid. The actuator 16 may be associated with a monitoring device 18 that monitors a width of the sheet path 115 during compilation of the sheets in the slot 112. The monitoring device 18 can be, for example, an optical detector that operates to generate a signal ("width signal") based on the difference in space between a detected surface of a sheet in the slot 112 and the movable baffle 14. The monitoring device 18 also can be comprised of a sensor, for example, an interrupter, reflective or actuator type sensor. Alternatively, the monitoring device 18 also can be comprised of a proximity sensor, such as a reed switch or a solid state magnetic proximity sensor. These sensors are actuated by magnet or shield, and offer high reliability and long operational life. Based on the width signal, the actuator 16 moves the movable baffle 14 toward or away from the compiling sheets in the slot 112. For example, the width signal is provided to a controller that then controls the actuator 16. That is, if the space between a surface of the compiling sheets in the slot 112 and the movable baffle 14 is of an amount that will result in sagging and/or buckling of the sheets in a paper path 115, the actuator 16 moves the movable baffle 14 toward the compiling sheets. On the other hand, if the space between a surface of the compiling sheets in the slot 112 and the movable baffle 14 is of an amount that is too small to accommodate the growing size of the compiling sheets (i.e., set size) in a paper path 115, the actuator 16 moves the movable baffle 14 away the compiling sheets. In general, the movable baffle 14 is moved from a first position closest to the fixed baffle 12 at the start of compilation of a set, to subsequent positions progressively farther from the fixed baffle 12 as more sheets compile in the slot. For example, the dashed line in FIG. 2 between the first baffle 12 and the second baffle 14 represents a position of the movable baffle 14 at the start of sheet compilation. As shown in FIG. 2, the movable baffle 14 is moved away from the fixed baffle 12 during compiling of sheets in the slot 112 to accommodate a growing set size.

The first baffle 12 and the second baffle 14 may be disposed on or in conjunction with any suitable guide or track which permits the baffles 12, 14 to move toward or away from each other. For example, the baffles 12, 14 may be guided by tabs keyed into front and rear frames of the apparatus 10.

In this manner, the actuator 16 of the apparatus 10 moves the movable baffle 14 to avoid excess space in the paper path 115 by automatically controlling/adjusting the paper path width as the sheets compile in the paper path 115. As a result, sagging and buckling of the sheets in the paper path 115 are prevented. Further, the apparatus 10 controls or adjusts the paper path width to increase the paper path width depending on the sheet set size as the sheets compile in the slot 112. Accordingly, set registration is enhanced.

The vertical compiling apparatus 10 may comprise a booklet maker, such as the booklet maker 110 shown in FIG. 1. Accordingly, the apparatus 10 may include a blade to fold sheet(s) accumulated in the slot 112, such as the blade 118 of FIG. 1. The apparatus 10 may further include a lift mechanism, such as the lift mechanism 116 of FIG. 1, that is movable within the slot 112 to move a predetermined portion of sheet(s) accumulated in the slot 112 to a position for binding and to a position for folding. These positions may correspond to the second and third positions, respectively, described above. Because the width of the paper path 115 is variable, the apparatus 10 can accommodate booklet sizes of over 25 sheets, as well as very small sets, without sagging.

Figure 3:
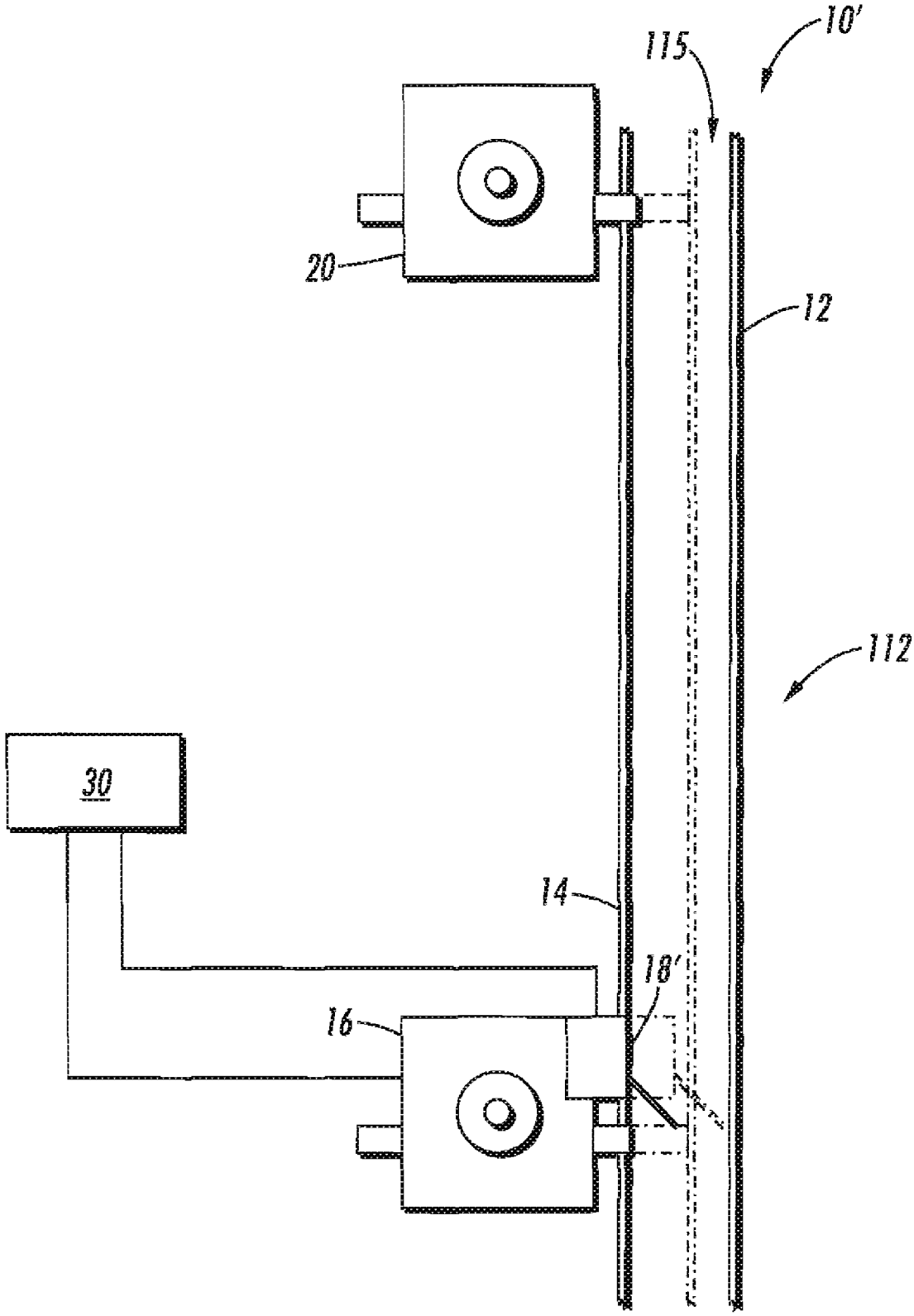
FIG. 3 is a detail view of an exemplary alternative vertical compiling apparatus.

FIG. 3 is a detail view showing the operation of an exemplary alternative vertical compiling apparatus 10' in conjunction with a booklet maker 110 shown in FIG. 1. The apparatus 10' may include all of the features and alternatives of the vertical compiling apparatus 10 illustrated and discussed with respect to FIG. 2, unless otherwise specified.

The vertical compiling apparatus 10' further includes a second actuator 20. The second actuator 20 is disposed at an upper portion of the sheet path 115. In the exemplary embodiment, the actuator 16 is disposed at a lower portion of the sheet path 115. The second actuator 20 moves an upper portion of the movable baffle 14 independently from a lower portion of the movable baffle 14, thereby adjusting a width of an upper portion of the sheet path 115 to a width different than a width of a lower portion of the sheet path 115. Preferably, the upper portion of the sheet path is kept wider than the lower portion. This exemplary embodiment allows the sheets easier entry into the sheet path 115, thereby optimizing the compiling of sheets in the slot. Accordingly, set registration is further improved.

The vertical compiling apparatus 10' also includes a monitoring device 18'. The monitoring device 18' operates to generate a "width signal" based on the difference in space or distance between a surface of the compiling sheets in the slot 112 and the movable baffle 14, as in FIG. 2. The monitoring device 18' may be comprised of any device or system that monitors, determines, or senses a distance to a detected object (in this instance, the stack of sheets in the slot). For example, the monitoring device 18' may be an optical sensor. Further alternative sensing embodiments may include software systems that may be programmed with algorithms to determine the distance between baffles based on the number of sheets fed to the slot (based on a known thickness of each sheet).

The generated width signal is sent to and received by an electronic control unit (controller) 30. The electronic control unit 30 sends a control signal to at least one of the actuators 16, 20 coupled movable baffle 14. At least one of the actuators 16, 20 that receives the control signal moves the baffle 14 toward or away from the compiling sheets in the slot 112 by an amount based on the width signal, thereby adjusting the width of the sheet path 115 as the sheets compile in the slot 112.

The vertical compiling apparatus 10' may also comprise the booklet maker 110. Accordingly, the apparatus 10' may also include the blade 118 to fold sheet(s) accumulated in the slot 112 and the lift mechanism 116 to move a predetermined portion of sheet(s) accumulated in the slot 112 to the second (binding) and third (folding) positions described above.

While exemplary embodiments have been described, these embodiments should be viewed as illustrative, and not limiting. It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art and are also intended to be encompassed.

What is claimed is:

1. A vertical sheet compiling apparatus for use in a sheet path of a sheet handling apparatus, the vertical sheet compiling apparatus comprising:

a slot that accumulates a plurality of sheets, the slot including a first baffle and a second baffle, the first baffle and the second baffle defining generally vertical sides of a sheet path of the slot and being separated from each other by a space therebetween;

a monitoring device for determining an amount of available space in the slot during compilation of the sheets in the slot;

an actuator coupled to at least one of the first and second baffles to move at least one of the baffles toward or away from the other one of the baffles based on the determined amount of available space, as the sheets are being compiled, thereby adjusting a thickness of the sheet path as the sheets compile in the slot;

a second actuator disposed at an upper portion of the sheet path; and a binding mechanism that fastens the plurality of sheets together, wherein the first baffle is a fixed baffle, the second baffle is a movable baffle, the actuator is coupled to and moves the movable baffle, and the second actuator moves an upper portion of the movable baffle independently from a lower portion of the movable baffle, thereby adjusting a thickness of an upper portion of the sheet path to a thickness different than a thickness of a lower portion of the sheet path.

2. The apparatus of claim 1, wherein the apparatus is a booklet maker and further comprises a blade to fold at least one sheet accumulated in the slot.

3. The apparatus of claim 2, further comprising:

a lift mechanism movable within the slot to move a predetermined portion of at least one sheet accumulated in the slot to a position for folding and to a position for binding.

4. The apparatus of claim 1, wherein the binding mechanism includes a stapler.

5. The apparatus of claim 1, wherein the actuator includes a motor.

6. A xerographic device comprising the apparatus of claim 1.

7. A vertical sheet compiling apparatus for use in a sheet path of a sheet handling apparatus, the vertical sheet compiling apparatus comprising:

a slot that accumulates a plurality of sheets, the slot including a first baffle and a second baffle, the first baffle and the second baffle defining generally vertical sides of a sheet path of the slot and being separated from each other by a space therebetween;

means for determining an amount of available space in the slot during compilation of the sheets in the slot;

an actuator coupled to at least one of the first and second baffles to move at least one of the baffles toward or away from the other one of the baffles based on the determined amount of available space, as the sheets are being compiled, thereby adjusting the thickness of the sheet path as the sheets compile in the slot;

a second actuator disposed at an upper portion of the sheet path; and a binding mechanism that fastens the plurality of sheets together, wherein the first baffle is a fixed baffle, the second baffle is a movable baffle, the actuator is coupled to the movable baffle to move the movable baffle toward and away from the fixed baffle, and the second actuator moves an upper portion of the movable baffle independently from a lower portion of the movable baffle, thereby adjusting a thickness of an upper portion of the sheet path to a thickness different than a thickness of a lower portion of the sheet path.

8. The apparatus of claim 7, wherein the means for determining an amount of available space includes a sensor.

9. The apparatus of claim 8, wherein the sensor is an optical sensor.

10. The apparatus of claim 7, wherein the apparatus is a booklet maker and further comprises a blade to fold at least one sheet accumulated in the slot.

11. A method of compiling vertically oriented sheets in a vertical sheet compiling apparatus in a sheet path of a sheet handling apparatus, the method comprising:

accumulating a plurality of sheets in a slot, the slot including a first baffle and a second baffle, the first baffle and the second baffle defining generally vertical sides of a sheet path of the slot and being separated from each other by a space therebetween;

determining an amount of available space in the slot during compilation of the sheets in the slot;

moving at least one of the first and second baffles toward or away from the other one of the baffles based on the determined amount of available space, as the sheets are being compiled, thereby adjusting the thickness of the sheet path as the sheets compile in the slot; and fastening the plurality of sheets together, wherein the first baffle is a fixed baffle, the second baffle is a movable baffle, the second baffle is moved in the moving by moving an upper portion of the movable baffle independently from a lower portion of the movable baffle, thereby adjusting a thickness of an upper portion of the sheet path to a thickness different than a thickness of the lower portion of the sheet path.

12. The method of claim 11, further comprising:

monitoring a thickness of the sheet path during compilation of the sheets in the slot;

generating a thickness signal that is received by an electronic control unit;

sending a control signal from the electronic control unit to an actuator coupled to at least one of the baffles; and moving the at least one of the baffles via the actuator based on the thickness signal.

13. The method of claim 11, further comprising:

folding at least one sheet accumulated in the slot.

14. The method of claim 11, wherein the fastening step includes stapling.

* * * * *